US005809754A

United States Patent [19]

Schulte

[11] Patent Number: 5,809,754

[45] Date of Patent: Sep. 22, 1998

[54] PIVOTABLE STEP FOR STIRRUPS

[76] Inventor: Frank Schulte, Country Rd. 357 Box 47, Mayo, Fla. 32066

[21] Appl. No.: 797,784

[22] Filed: Feb. 7, 1997

[51] Int. Cl.[6] ..... B68C 3/00

[52] U.S. Cl. ..... 54/47

[58] Field of Search ..... 54/47, 49, 49.5

[56] References Cited

U.S. PATENT DOCUMENTS

| | | | |
|---|---|---|---|
| 717,850 | 1/1903 | Hey et al. | 54/47 |
| 877,062 | 1/1908 | Easterwood . | |
| 2,935,833 | 5/1960 | Woodhead . | |
| 4,761,938 | 8/1988 | Townsend . | |

FOREIGN PATENT DOCUMENTS

| | | | |
|---|---|---|---|
| 2258772 | 9/1975 | France . | |
| 41607 | 6/1887 | Germany | 54/47 |
| 105949 | 1/1899 | Germany | 54/47 |
| 3734795 | 5/1989 | Germany | 54/47 |
| 14094 | of 1909 | United Kingdom | 54/47 |

*Primary Examiner*—Robert P. Swiatek
*Attorney, Agent, or Firm*—Dowell & Dowell, P.C.

[57] ABSTRACT

An auxiliary step for a stirrup associated with a saddle wherein the auxiliary step is mounted so as to be pivotable from a first position generally adjacent to the stirrup to a second position spaced below the stirrup to thereby assist a rider in mounting the saddle. In a preferred embodiment, the step is positively urged to the first or raised position adjacent to the stirrup when not being used to assist the rider in mounting.

17 Claims, 3 Drawing Sheets

PIVOTABLE STEP FOR STIRRUPS

BACKGROUND OF THE INVENTION

1. Field of the Invention

This invention is generally directed to improvements in saddlery and more particularly to a pivotable step which may be used with conventional stirrups in such a manner that the step is movable to a position below the stirrup to thereby be accessible to assist riders in mounting saddles.

2. History of the Related Art

Stirrups associated with saddles are generally designed to be adjustably supported in varying vertical relationships with respect to a saddle positioned on the back of a mount by stirrup leathers or straps. As shown in FIG. 2, the strap normally includes a buckle which allows the strap to be vertically adjusted to suit the individual rider so that the stirrup is conveniently positioned for being engaged by the rider's foot when mounting the saddle. In some instances, however, the stirrup strap is not sufficiently adjustable to permit the stirrup to be convenient for use, especially if the mount is a larger horse or the rider is an individual, such as a young child, who does not have the physical size to elevate their foot to the lowest position obtainable by adjustment of the stirrup strap.

Because of the foregoing, it is often necessary for young riders or riders who are riding large horses to have assistance when mounting the saddle. It would be preferred to further facilitate the manner in which riders mount by providing an extension to conventional stirrups.

SUMMARY OF THE INVENTION

The present invention is directed to an auxiliary step for use with stirrups wherein the stirrups include a foot engaging base from which extend opposite sidewalls which are connected at upper ends to an upper wall which is normally supported by a stirrup leather or strap. The auxiliary step includes a support spindle having a first portion which is mounted so as to be pivoted with respect to the foot engaging base of the stirrup and which includes a second portion which extends generally transversely thereto to an outer end to which a step is mounted. In the preferred embodiment, the step is pivotally mounted to the outer end of the second portion of the support spindle.

Also, in the preferred embodiment, a coil spring is provided mounted within a housing which is itself rotatably mounted to the foot engaging base of the stirrup. The spring is designed to engage the housing to which the support spindle is fixed through a ratchet assembly so that when the second portion of the support spindle is moved from a first position generally adjacent one of the sidewalls of the stirrup to a second position extending below the foot engaging base portion of the stirrup, the spring is compressed or rotationally loaded so that it tends to urge the second portion of the support spindle back to the first position. In some embodiments, the second portion of the support spindle includes first and second segments so that the length of the second portion may be selectively altered depending upon the desired spacing of the auxiliary step relative to the foot engaging base portion of the stirrup.

It is the primary object of the present invention to provide an auxiliary step for use with stirrups associated with saddles wherein the auxiliary step is mounted in an out-of-the-way position so as not to interfere with or obstruct the normal use of the stirrup but wherein the auxiliary step may be pivoted from the normally raised or non-use position to a position of use extending below the stirrup so that the auxiliary step may be easily engaged to assist a rider in mounting a saddle.

It is also an object of the present invention to provide an auxiliary step for use with conventional stirrups used on saddles wherein the auxiliary step is positively urged to a raised position where it will not obstruct normal use of the stirrup but wherein the step may be easily pivoted to a lower position in order to assist an individual in mounting a saddle.

It is yet another object of the present invention to provide auxiliary steps for use with conventional stirrups used on saddles which are relatively inexpensive and are easily mounted for use as a retrofit to existing stirrups.

DESCRIPTION OF THE PREFERRED EMBODIMENT

Figure 1:
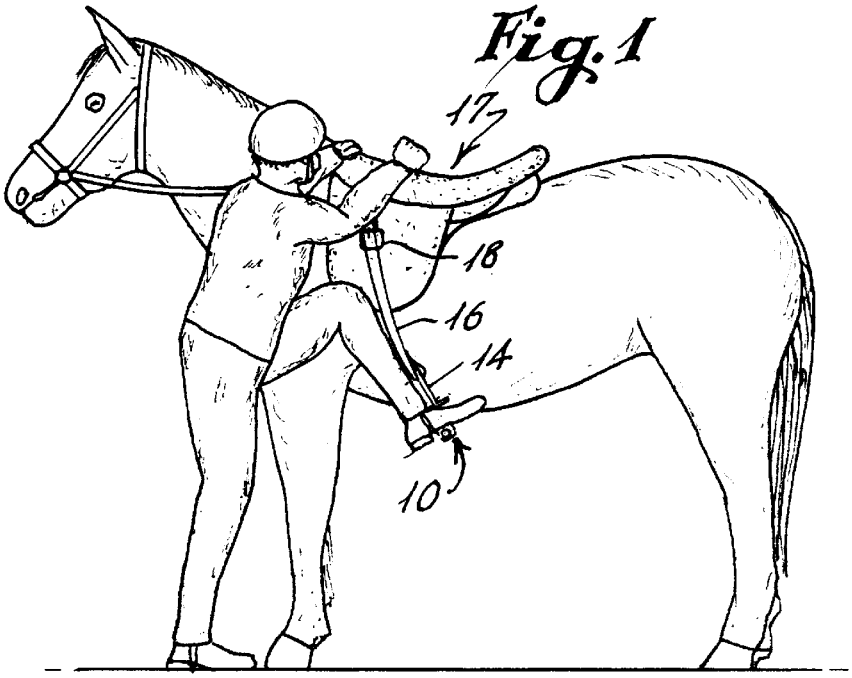
FIG. 1 is a perspective illustrational view of the present invention showing a rider using the auxiliary step in order to mount a horse.
Figure 2:
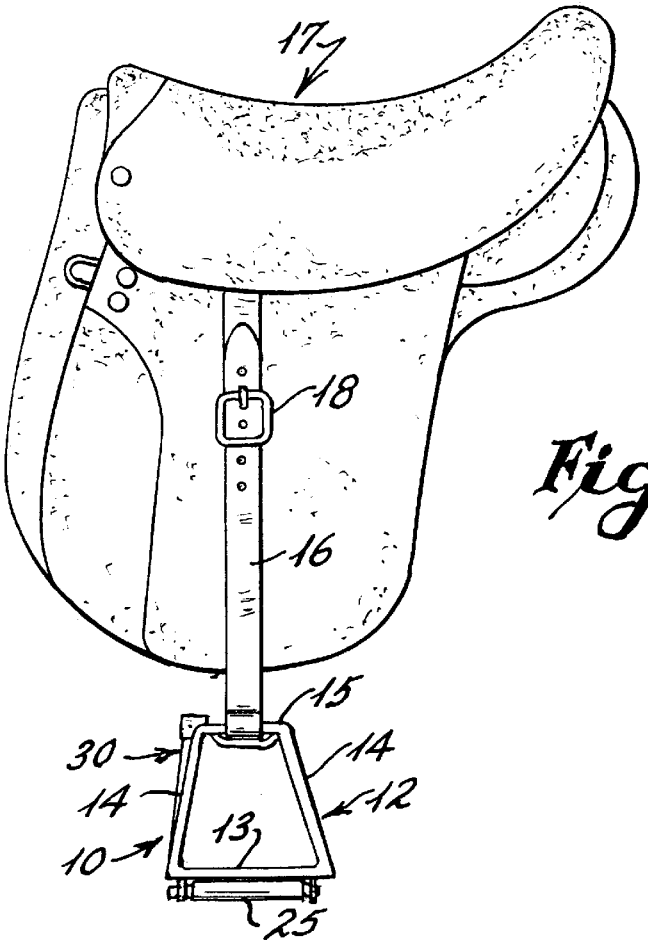
FIG. 2 is a side elevational view of a saddle showing a stirrup to which the auxiliary step of the present invention is secured with the auxiliary step being in a first raised non-use position.

With continued reference to the drawing figures, the auxiliary step 10 of the present invention is designed to be utilized in conjunction with a conventional stirrup 12. The stirrup includes a foot engaging base portion 13 and opposite sidewalls 14 which extend upwardly from the base portion and which are connected to a top wall portion 15. The stirrup is conventionally connected to a stirrup leather or strap 16 which is adjustable in length by way of a buckle 18 and which is connected to a saddle 17.

Figure 6:
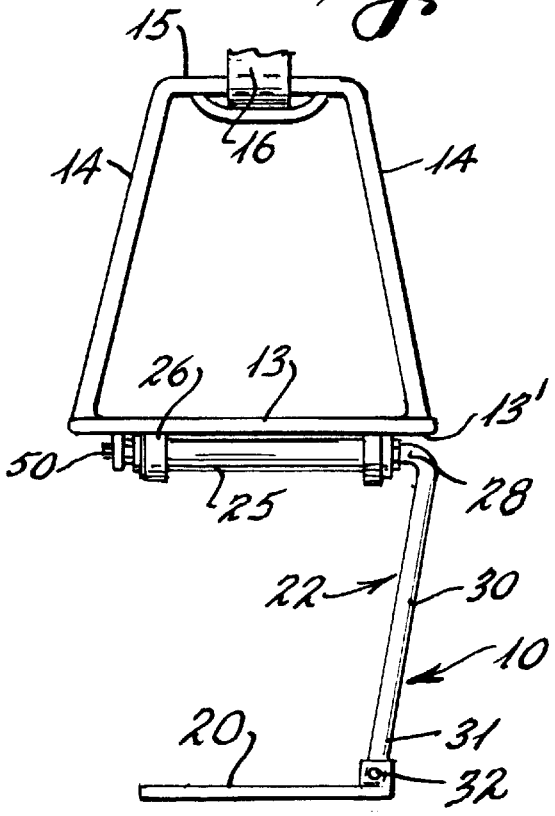
FIG. 6 is a view similar to FIG. 4 showing the step in a lowered or use position.

In some instances, especially with larger horses, conventional stirrup straps can not be vertically adjusted low enough to enable a rider to conveniently place his or her foot within the stirrup to mount the saddle. Therefore, the present invention is designed to be utilized with substantially any conventional stirrup to thereby function as an extension of the stirrup. In use, and as shown in FIG. 1, the step is designed to be pivoted vertically below the foot engaging base portion 13 of the stirrup to a position which is comfortable and convenient for the rider to engage when mounting the saddle. The orientation of the step when being utilized is shown in FIG. 6 and the orientation when the step is not being utilized is shown generally in FIG. 4. In the raised or non-use position, the auxiliary step is designed to extend along one of the sidewalls 14 of the stirrup so as to not adversely interfere with the normal use of the stirrup.

Figure 10:
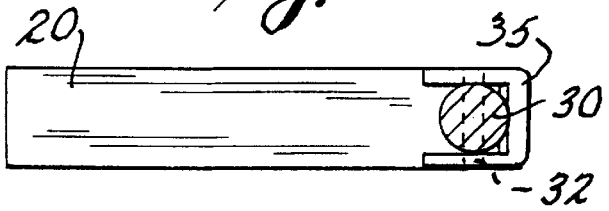
FIG. 10 is an enlarged view showing a pivot connection for the step with respect to a second portion of the support spindle which supports the step from the stirrup and which is a cross section taken along lines 10—10 of FIG. 11.
Figure 11:
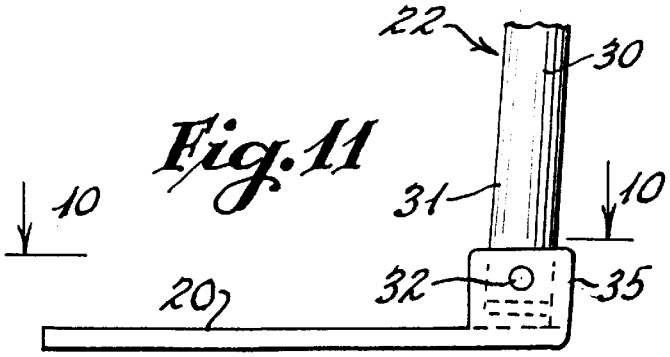
FIG. 11 is a front elevational view of the auxiliary step showing the pivot attachment to the outer end of the second portion of the support spindle by way of which the step is attached to the stirrup.
Figure 12:
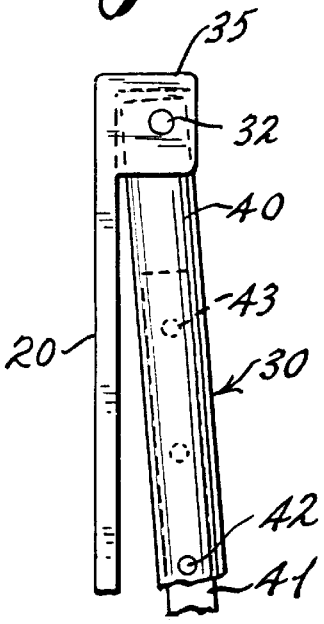
FIG. 12 is an illustrational view showing the manner in which the step is aligned generally with the second portion of the supporting spindle when in a non-use position, as is shown in FIGS. 2–4.

The step 10 includes a step member 20 which is connected to a support spindle 22, so as to be oriented generally parallel to the foot engaging base portion of the stirrup when in use, as shown in FIG. 6. The support spindle 22 includes a first generally L-shaped portion 23 which includes a rod segment 24 which is mounted for rotation to a rotatable housing 25 which is mounted to the undersurface 13' of the foot engaging portion 13 of the stirrup by a pair of spaced brackets 26 and 27. Suitable bearing 29 are provided between the housing and the brackets 26 and 27. The brackets may be welded or secured by other suitable fasteners, such as rivets, to the foot engaging base portion 13. A shorter rod segment 28 extends generally at a right angle to the elongated rod segment 24 and is integrally formed at its outer end with a second rod portion 30 having an outer end portion 31 which extends away from the housing 25. In the preferred embodiment, the step member 20 is pivotally connected at 32 to the outer end portion 31 of the second rod portion 30 of the spindle 22. In order to limit the pivotal movement of the step member 20 relative to the spindle 22, the step member may include a generally U-shaped integrally formed flange 35 at one end thereof through which the pivot pin 32 extends, as is shown in FIGS. 10–12. The flange 35 acts as a stop abutting the second rod portion of the spindle, as shown in FIG. 10, when the step member 20 is in the horizontal position.

Figure 3:
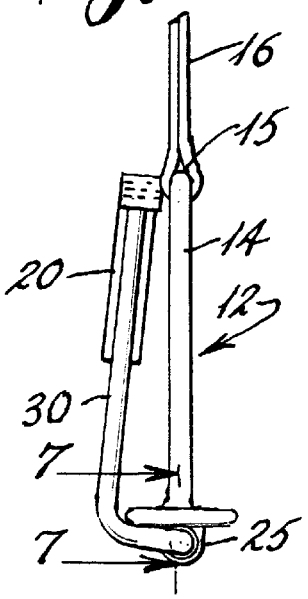
FIG. 3 is a view taken from the left side of the stirrup shown in FIG. 2.
Figure 4:
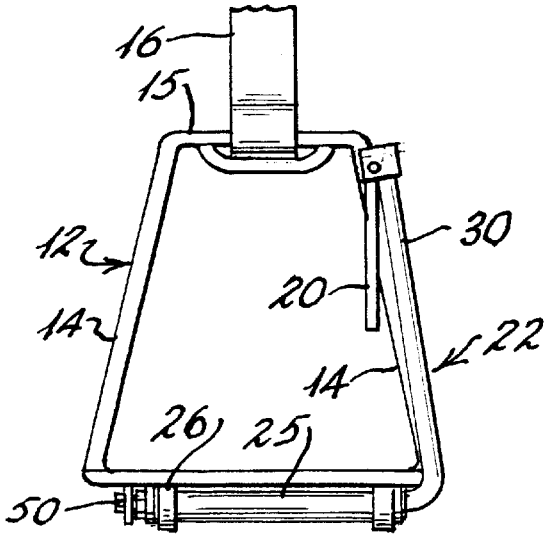
FIG. 4 is an enlarged view showing the rear of the stirrup as shown in FIG. 2 together with the step of the present invention.
Figure 5:
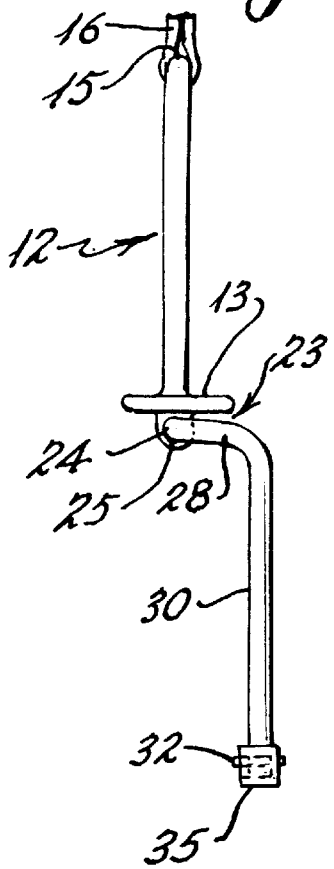
FIG. 5 is a view similar to FIG. 3 showing the auxiliary step in a lowered use position.

When the auxiliary step is in a raised or non-use position, such as shown in FIGS. 3, 4 and 12, the step member 20 is designed to pivot by gravity so that it extends generally along the length of the second rod portion 30 of the spindle 22. In this position, the second rod portion of the support spindle 22 generally aligns with one of the sidewalls 14 of the stirrup so that the step member 20 also generally aligns with the same sidewall of the stirrup. Because of this alignment, both the step member 20 and the spindle 22 do not obstruct the normal opening defined by the wall portions of the stirrup.

In use, the spindle is moved by rotating the first rod segment 24 with the housing 25 so as to lower the step member to the position shown in FIG. 6. During this movement, the step member may be pivoted about pivot 32 so as to extend horizontally to allow the step member to be engaged by the foot of a rider. It should be noted that although the auxiliary step is shown in the drawing figures mounted so that the step extends to the left in FIGS. 3–6, the housing may be reversely mounted so that the step would extend to a right opening in the same drawing figures. This facilitates the use of the auxiliary step depending upon the preference of the rider to mount utilizing either a left or right foot.

To further provide for adjustability of the auxiliary step, the second rod portion 30 of the support spindle 22 may be designed to be adjustable in length. As shown in FIG. 12, this may be accomplished by constructing the second rod portion 30 to include a telescoping sleeve 40 which is slidably engageable over a rod segment 41. The sleeve 40 may be selectively secured in an adjusted position with respect to the rod 41 by a pin 42 which is aligned with openings 43 provided in vertically spaced relationship along the length of the rod 41.

Although the auxiliary step 10 of the present invention may be freely pivotally movable with respect to either the housing 25 or the foot engaging portion 13 of the stirrup, with a suitable latch being provided to retain the step member in the raised position shown in FIG. 4, in the preferred embodiment, the spindle and step member are positively urged by a suitable spring assembly so that once the step is utilized, the step will pivot upwardly to the raised position of FIG. 4. Various structures may be provided for accomplishing this positive force.

Figure 7:
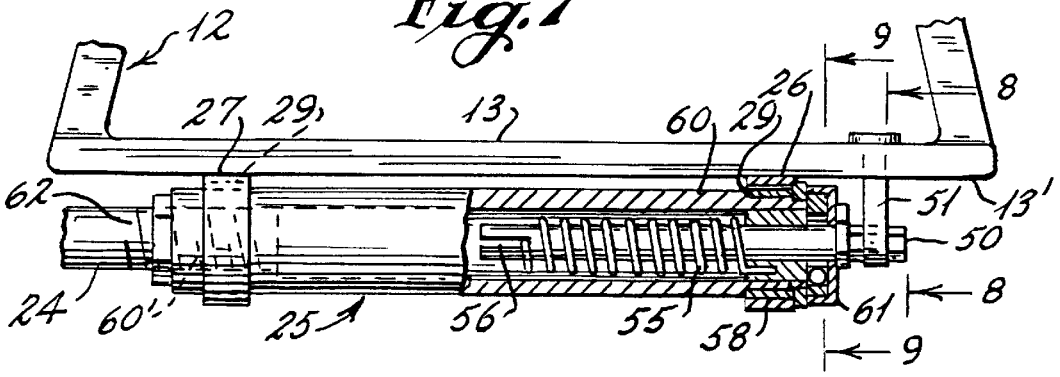
FIG. 7 is an enlarged view having portions broken away showing a coil spring mounted within a housing which supports the spindle for the auxiliary step of the present invention.

With particular reference to FIG. 7, one structure for providing the rotational motion for the support spindle 22 is shown in detail. In this embodiment, a fixed stub shaft 50 is secured to an anchoring member 51 mounted through the foot engaging base portion 13 of the stirrup in such a manner that the stub shaft 50 can not rotate relative to the foot engaging base portion. As previously described, the housing is mounted by bearings 29 so as to be rotatable with respect to the mounting flanges 26 and 27. A coil spring 55 is mounted so that one end thereof is disposed within a slot 56 formed in one end of the stub shaft while the other end of the spring is mounted within a roller 58 which is frictionally engaged inside of and with one end 60 of the housing 25. The other end 60' of the housing threadingly receives a threaded end portion 62 of the first rod portion of the support spindle 22. Without additional structure being provided, if the spindle member 22 is rotated together with the housing 25, the spring member will be compressed in rotation as the step member 20 is lowered from the raised position of FIG. 4 to the position shown in FIG. 6. This action causes the spring to wind about the stub shaft so that the spring exerts a force on roller 58 to pivot the housing 25 to raise the step member 20 to the elevated position of FIG. 4 once pressure is relieved from the step member.

Figure 8:
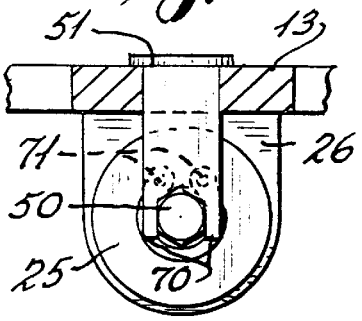
FIG. 8 is a cross-sectional view taken along line 8—8 of FIG. 7.
Figure 9:
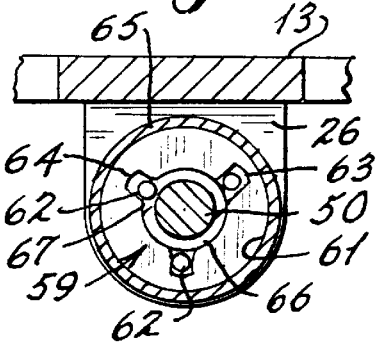
FIG. 9 is a cross-sectional view taken along line 9—9 of FIG. 7.

However, the invention further contemplates that the step member may be momentarily retained in the lower position shown in FIG. 6 by providing a ratchet assembly 59, see FIGS. 7–9, which cooperates with the rotatable housing 25 to lock the support spindle in the lower position until a slight pressure is applied to initiate rotation of the housing to the position shown in FIG. 4. Upon a slight force being applied to initiate rotation of the housing, the ratchet assembly releases engagement of the housing with the stub shaft and thereby allows rotation of the housing about the stub shaft.

With specific reference to FIGS. 7–9, the ratchet assembly is mounted in an enclosure 61 at one end of the housing 25. Retention balls 62 are resiliently seated against springs 63 in recesses 64 in a sleeve 65 surrounding the stub shaft 50 and which is mounted within the enclosure 61. A ratchet disc 66 having one or more teeth 67 is mounted to the stub shaft. Depending on the position of the housing relative to the stub shaft 50, one of the balls 62 will engage a ratchet tooth to thereby resist rotation of the housing to raise the step member 20 to its raised position, as shown in FIG. 9. However, by applying a slight pressure against the step member to rotate the support spindle 22 toward the raised position, the retention ball will be forced back into its associated recess 64 thereby allowing the housing to rotates relative to the stub shaft under the influence of the spring.

The spring tension placed on the housing may be selectively adjusted by pre-loading the spring. Mounted on the exterior of the enclosure 61 are a pair of pivotable locks 70, FIG. 8, shaped so as to positively engage opposite sides of the stub shaft which is designed to include flat wall segments. By pivoting the locks away from the stub shaft, the housing may be rotated to wind the coil spring. When sufficient tension is applied, the locks are pivoted about pins 71 into engagement with the stub shaft to thereby retain the housing in a normal or rest position wherein the step member is in the raised position of FIG. 4. When the step member is lowered, the housing will further compress or wind the spring which will then have sufficient force to raise the step member as soon as a slight pressure is applied to reseat the retention balls as previously described.

The foregoing description is directed to providing a rotatable housing in which the first rod portion of the support spindle is fixed to the housing. In some embodiments, the first rod portion 24 of the support spindle may itself be rotatably mounted within a fixed housing and still be operable in accordance with the teachings of the present invention. Further, any other suitable spring mechanism may be provided for positively urging the support spindle to the raised or non-use position.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

I claim:

1. In a stirrup for a saddle having a foot engaging base portion from which upwardly extend sidewalls which are connected to an upper wall adapted to be suspended from a stirrup strap, the improvement comprising: a step member, means for pivotally mounting said step member to the stirrup so as to be movable from a first position above the foot engaging base portion to a second position spaced from and below the foot engaging base portion and generally parallel thereto, said means for pivotally mounting said step member including a spindle having a first portion pivotally mounted to the stirrup such that the first portion is retained in parallel relationship to the foot engaging base portion about an axis that extends in a direction between the side walls of the stirrup so that the first portion of the spindle does not interfere with the conventional use of the stirrup, said spindle including a second portion extending generally perpendicular with respect to said first portion, and said step member extending from said second portion of said spindle whereby said step member may be lowered from said first position to said second position to form an extension of the stirrup to assist a rider in mounting a saddle.

2. The stirrup of claim 1 in which said means for pivotally mounting includes a spindle pivotally mounted relative to the foot engaging base portion of the stirrup and resilient means engageable with said spindle to normally urge said step member to said second position.

3. The stirrup of claim 2 including pivot means for pivotally connecting said step member to said spindle whereby said step member extends along one of the stirrup sidewalls in the first position and extends parallel to the foot engaging base portion in said second position.

4. The stirrup of claim 3 including stop means extending from said step member and engageable with said second portion of said spindle when said step member is in said second position.

5. The stirrup of claim 4 including a housing, fastening members for rotatably mounting said housing to the foot engaging base portion of the stirrup, and said spindle including a first portion mounted to said housing and said resilient means being mounted within said housing.

6. In a stirrup for a saddle having a foot engaging base portion from which upwardly extend sidewalls which are connected to an upper wall adapted to be suspended from a stirrup strap, the improvement comprising: a step member, means for pivotally mounting said step member to the stirrup so as to be movable from a first position above the foot engaging base portion to a second position spaced from and below the foot engaging base portion and generally parallel thereto, said means for pivotally mounting said step member to the stirrup including a housing, means for rotatably mounting said housing relative to said foot engaging base portion of the stirrup, a fixed stub shaft mounted to the foot engaging base portion of the stirrup and extending within said housing, a spring element surrounding said stub shaft and having one end engagable with said stub shaft and another end connected to said housing whereby when said housing is rotated from said first to said second position, said spring element is placed into compression.

7. The stirrup of claim 6 further including a ratchet assembly mounted within said housing, said ratchet assembly including means for resisting rotation of said housing to prevent movement of said step member from said second position to said first position until sufficient pressure is applied to overcome said ratchet assembly and permit rotation of said housing relative to said fixed stub shaft.

8. The stirrup of claim 7 including locking means mounted to said housing for engaging said stub shaft for permitting a pre-tensioning of said spring element relative to said stub shaft.

9. An auxiliary step for a stirrup wherein the stirrup includes a foot engaging base which is connected by side members to an upper portion connected to a stirrup strap, the auxiliary step comprising: a support spindle, a housing mounted to the stirrup, said spindle including a first portion mounted to said housing and a second portion extending outwardly generally transversely with respect to said first portion to an outer end, said first portion of said support spindle being pivotal such that said second portion is moveable in an arc from a first position adjacent one of the side walls of the stirrup to a second position extending below the foot engaging base of the stirrup, and a step member connected to and extending outwardly from said outer end of said second portion of said spindle.

10. The auxiliary step of claim 9 including pivot means for pivotally connecting said step member to said outer end of said second portion of said spindle.

11. The auxiliary step of claim 10 including a stop means extending from said step member, said stop means being engageable with said second portion of said spindle when said step member is pivoted generally transversly to said second portion of said support spindle.

12. The auxiliary step of claim 11 wherein in said stop means is a generally U-shaped flange integrally formed with said step member.

13. The auxiliary step of claim 12 wherein said first portion of said spindle is generally L-shaped having a long segment and a short segment, said second portion of said spindle extending from said short segment.

14. The auxiliary step of claim 9 including a spring member mounted within said housing, said spring member being placed in rotational compression when said second portion of said spindle is pivoted from a first position relative to said housing through an arc to a second position remote from said first position whereby said spring member continuously urges said second portion of said spindle to said first position.

15. The stirrup of claim 14 including means for rotatably mounting said housing relative to said foot engaging base portion of the stirrup, a stub shaft adapted to be mounted to the foot engaging base portion of the stirrup and extending within said housing, said spring element surrounding said stub shaft and having one end engagable with said stub shaft and another end connected to said housing whereby when said housing is rotated from the first to the second position, said spring element is placed into compression.

16. The stirrup of claim 15 further including a ratchet assembly mounted within said housing, said ratchet assembly including means for resisting rotation of said housing to prevent movement of said step member from the second position to the first position until sufficient pressure is applied to overcome said ratchet mechanism and permit rotation of said housing relative to said stub shaft.

17. The stirrup of claim 16 including locking means mounted to said housing for engaging said stub shaft for permitting a pre-tensioning of said spring element relative to said stub shaft.

* * * * *